US005819462A

United States Patent [19]

Dockery

[11] Patent Number: 5,819,462

[45] Date of Patent: Oct. 13, 1998

[54] WEAPON SUPPORTING ASSEMBLY

[76] Inventor: Joseph W. Dockery, 324 McCahill La., Ferndale, Calif. 95536

[21] Appl. No.: 912,533

[22] Filed: Aug. 18, 1997

[51] Int. Cl.[6] ..... F41C 27/00

[52] U.S. Cl. ..... 42/94; 211/64

[58] Field of Search ..... 42/94; 248/121; 211/64

[56] References Cited

U.S. PATENT DOCUMENTS

| | | | |
|---|---|---|---|
| 2,664,659 | 1/1954 | Parker | 42/94 |
| 3,007,581 | 11/1961 | Moore | 211/64 |
| 3,876,078 | 4/1975 | Gomes et al. | 211/64 |
| 3,952,878 | 4/1976 | Gorham | 211/64 |
| 4,089,423 | 5/1978 | Gorham et al. | 211/64 |
| 4,144,971 | 3/1979 | Balibrea | 211/64 |
| 4,271,969 | 6/1981 | Gnesa | 211/64 |
| 5,680,939 | 10/1997 | Oliver | 211/64 |

*Primary Examiner*—Charles Jordan
*Assistant Examiner*—Meena Chelliah

[57] ABSTRACT

The present invention relates to an assembly which can be employed to support a weapon in an upright orientation. The assembly is such that it can easily be disassembled, transported to a hunting sight, and reassembled for use. In its broadest context, the present invention includes a stand which is adapted to be inserted into the ground. The stand, in the preferred embodiment, can be removably coupled at one or more locations. Additionally, a butt receiving piece is adapted to be removably secured to the lower extent of the stand. A weapon supporting arm, in turn, is adapted to be removably secured to the upper extent of the stand. Thus, when assembled, the assembly provides a convenient means to keep a weapon upright and at the ready.

5 Claims, 3 Drawing Sheets

FIG 3
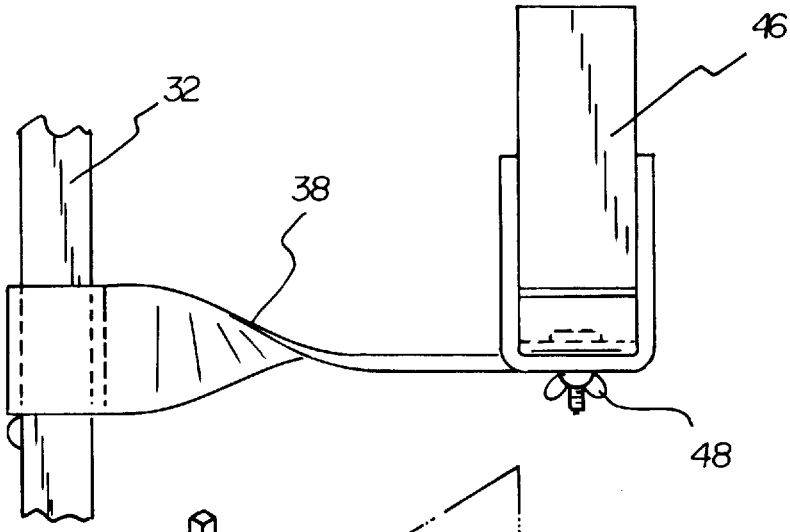
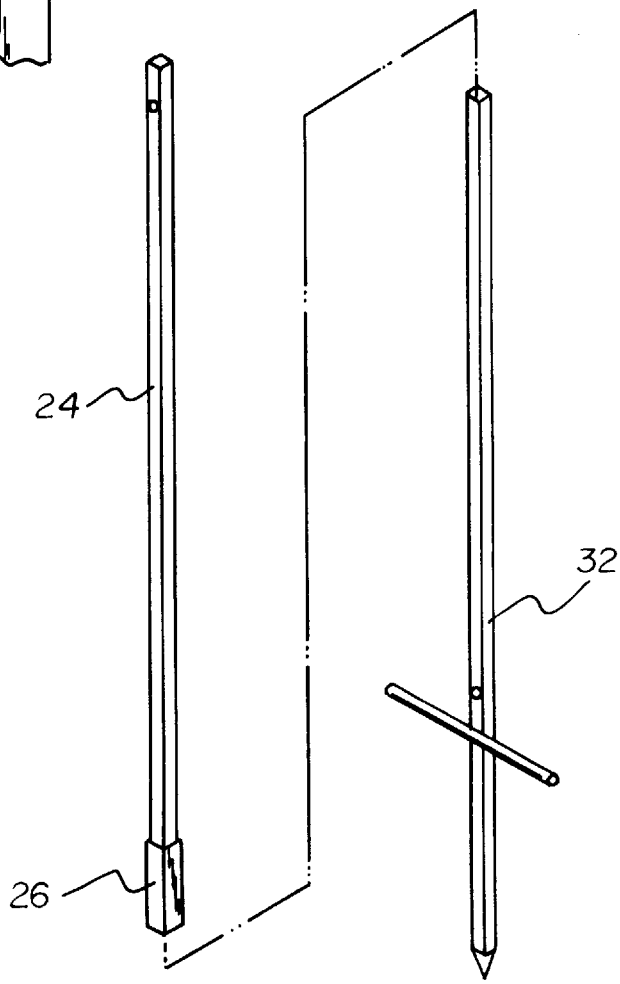
FIG 4

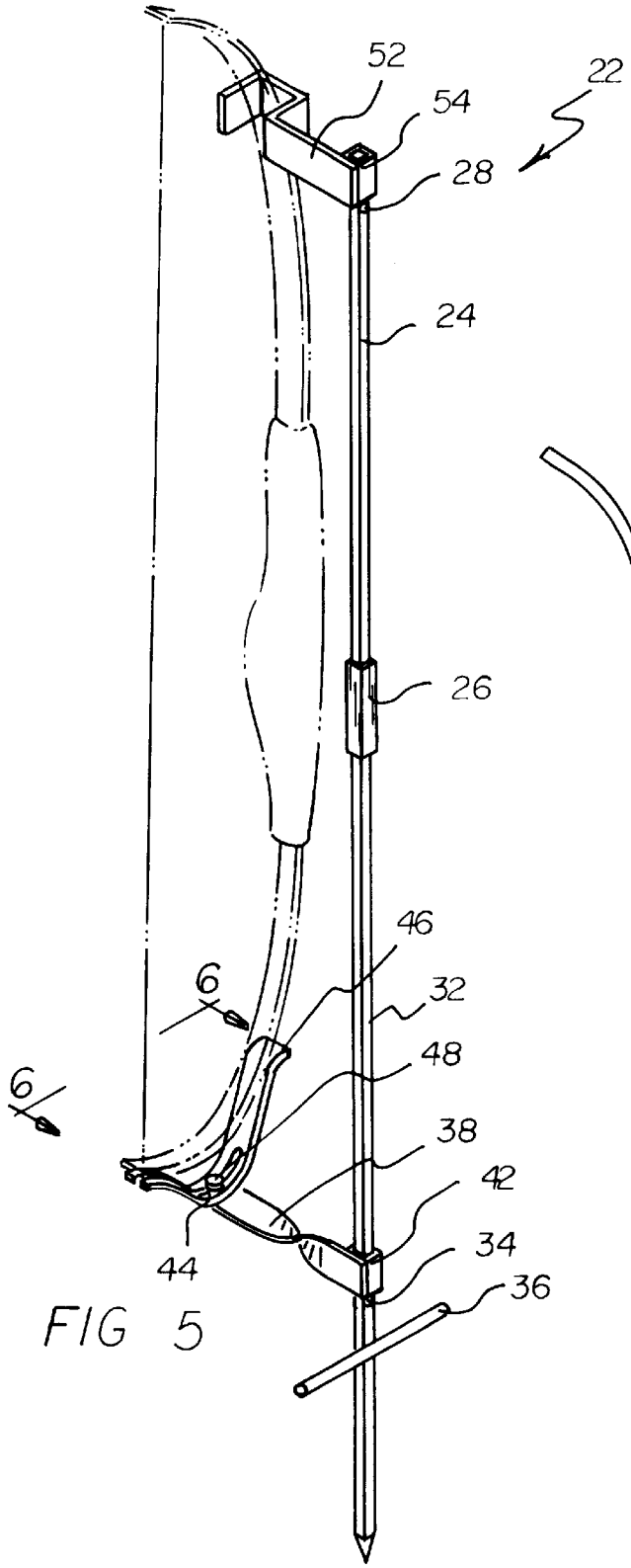
FIG 5
FIG 6
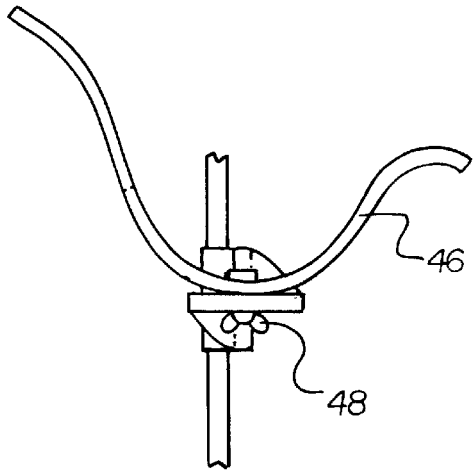

WEAPON SUPPORTING ASSEMBLY

BACKGROUND OF THE INVENTION

1. Field of the Invention

The present invention relates to a weapon supporting assembly and more particularly pertains to such an assembly that can be easily transported.

2. Description of the Prior Art

The use of bow stands is known in the prior art. More specifically, such bow stands are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,846,140 to DiMartion discloses a Spike Stand for a Compound Archery Bow. U.S. Pat. No. 5,205,272 to Boyer discloses a bow stablilizer and stand combination. U.S. Design Pat. No. 281,344 to Duke discloses a bow holder device. U.S. Pat. No. 5,106,044 to Regard, III discloses a portable compound bow stand. U.S. Pat. No. 4,993,398 to Wallace discloses a archery bow support stand. Lastly, U.S. Pat. No. 5,183,231 to Pellerin discloses a bow pod holder.

In this respect, the weapon supporting assembly substantially departs from the conventional concepts and designs of the prior art, and in so doing provides an apparatus primarily developed for the purpose of a weapon support that can be easily assembled and disassembled.

Therefore, it can be appreciated that there exists a continuing need for more convenient weapon stands. In this regard, the present invention substantially fulfills this need.

SUMMARY OF THE INVENTION

In view of the foregoing disadvantages inherent in the known types of bow stands now present in the prior art, the present invention provides a weapon supporting assembly that can be employed as a gun support or a bow support. As such, the general purpose of the present invention, which will be described subsequently in greater detail, is to provide a weapon support that can be easily assembled or disassembled.

To attain this, the present invention essentially comprises an assembly which can be employed to support a weapon in an upright orientation. The assembly is such that it can easily be disassembled, transported to a hunting sight, and reassembled for use. In its broadest context, the present invention includes a stand which is adapted to be inserted into the ground. The stand, in the preferred embodiment, can be removably coupled at one or more locations. Additionally, a butt receiving piece is adapted to be removably secured to the lower extent of the stand. A weapon supporting arm, in turn, is adapted to be removably secured to the upper extent of the stand. Thus, when assembled, the assembly provides a convenient means to keep a weapon upright and at the ready.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved assembly for supporting a gun in an upright orientation. The assembly comprises an upper square stand having an upper extent and a lower extent, an interconnection piece secured to the lower extent of the upper stand. A protrusion is formed proximate to the upper extent. A lower square stand has an upper extent, a lower extent and an intermediate extent therebetween, with a protrusion formed at the intermediate extent of the lower stand. A footbrace is formed perpendicular to the lower stand and formed proximate to the lower extent. The lower extent of the lower stand is pointed to facilitate the insertion of the lower stand into the ground. A butt supporting arm includes a proximal end, a distal end and an intermediate extent therebetween, with the intermediate extent of the butt supporting arm being twisted. A square aperture is formed integrally with the proximal end, and an aperture is formed at the distal of the butt supporting arm. The aperture of the butt supporting arm is position over the lower stand and in engagement with the protrusion of the lower stand. The assembly includes a butt receiving piece which has at least two upstanding arms, and an aperture formed within the butt receiving piece. A threaded engagement member is secured to the butt receiving arm to the butt supporting arm by way of the aperture of the butt receiving arm and the aperture in the butt receiving piece. The butt receiving piece is dip coated in an elastomeric material. The assembly also includes a supporting piece which includes a proximal end and a distal end. A square aperture is formed within the proximal end, with the distal end adapted to support a weapon. The proximal end is adapted to be positioned over the upper extent of the upper stand such that the aperture of the supporting piece comes into contact with the protrusion of the upper stand. The supporting piece is dip coated in an elastomeric material. The lower extent of the upper stand is adapted to be secured to the upper extent of the lower stand by way of the interconnection piece.

It is another object of the present invention to provide a weapon support that can be configured to support a gun or bow.

An even further object of the present invention is to provide a weapon supporting assembly which is susceptible of a low cost of manufacture with regard to both materials and labor, and which accordingly is then susceptible of low prices of sale to the consuming public, thereby making such weapon supporting assemblies economically available to the buying public.

Still yet another object of the present invention is to provide a weapon supporting assembly which provides in the apparatuses and methods of the prior art some of the advantages thereof, while simultaneously overcoming some of the disadvantages normally associated therewith.

Still another object of the present invention is to provide a weapon supporting assembly which can be easily assembled and disassembled.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view taken along line 3—3 of FIG. 1.

FIG. 4 is an exploded view of the upper and lower stands.

FIG. 5 is perspective view of the bow support of the present invention.

FIG. 6 is a view taken along line 6—6 of FIG. 5.

Similar reference characters refer to similar parts throughout the several views of the drawings.

DESCRIPTION OF THE PREFERRED EMBODIMENT

Figure 1:
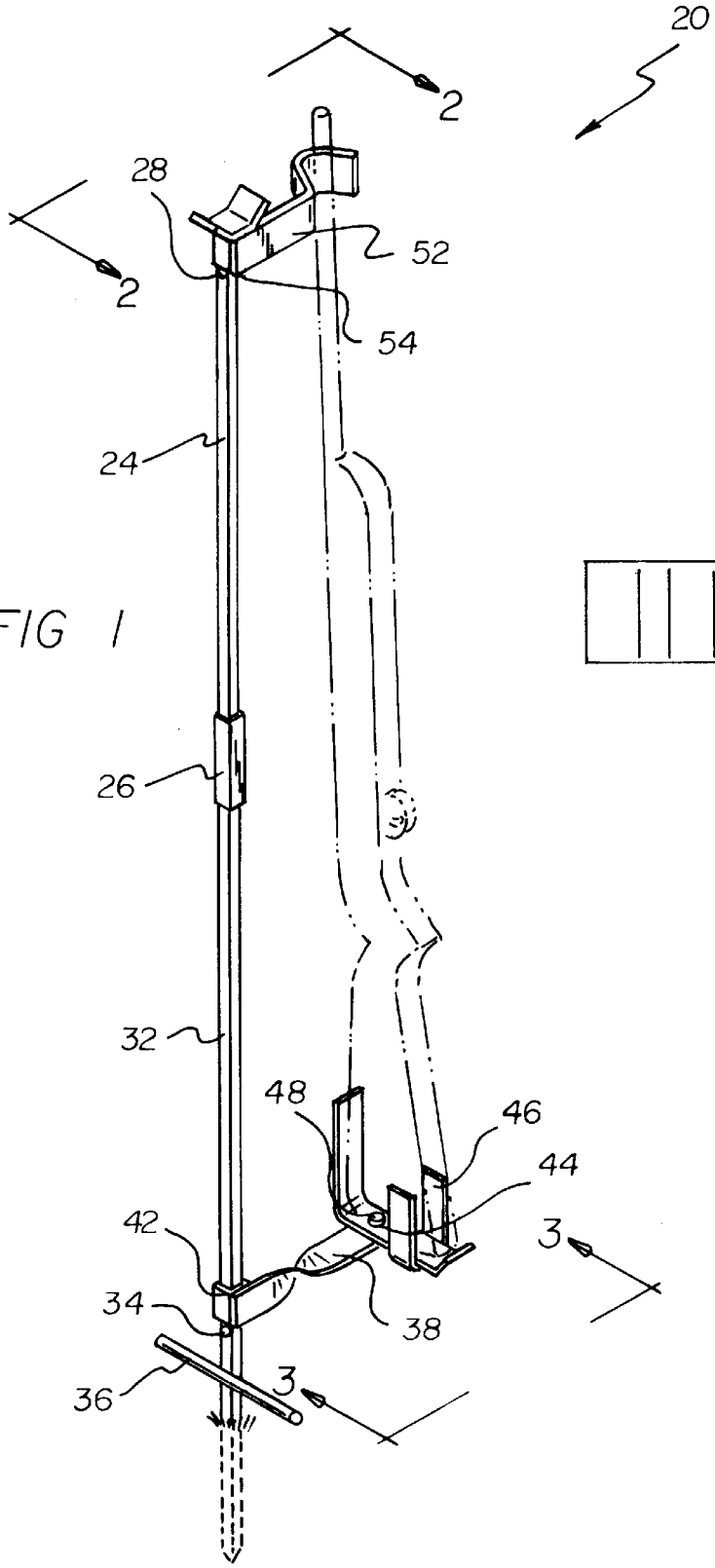
FIG. 1 is a perspective view of the gun supporting assembly of the present invention.

The present invention relates to an assembly which can be employed to support a weapon in an upright orientation. The assembly is such that it can easily be disassembled, transported to a hunting sight, and reassembled for use. In its broadest context, the present invention includes a stand which is adapted to be inserted into the ground. The stand, in the preferred embodiment, can be removably coupled at one or more locations. Additionally, a butt receiving piece is adapted to be removably secured to the lower extent of the stand. A weapon supporting arm, in turn, is adapted to be removably secured to the upper extent of the stand. Thus, when assembled, the assembly provides a convenient means to keep a weapon upright and at the ready.

The preferred embodiments of the present invention will be described in the context of a bow supporting assembly 22 and a gun supporting assembly 20. These two embodiments, however, share similar parts. Thus, similar parts will be designated by the same reference numerals.

Figure 2:
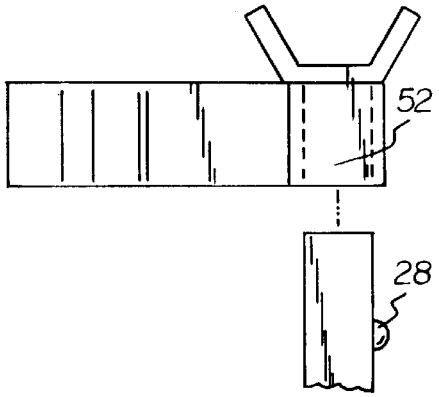
FIG. 2 is a view taken along line 2—2 of FIG. 1.

The gun supporting assembly 20 is depicted in reference to FIGS. 1 and 2. The assembly 20 includes an upper square stand 24. This upper square stand 24 is defined by an upper extent and a lower extent. Additionally, an interconnection piece 26 is secured to the lower extent of the upper stand 24. The upper stand 24 also includes a protrusion 28 formed proximate to the upper extent. This protrusion 28 is illustrated in FIG. 2.

The lower square stand 32 is likewise defined by an upper extent, a lower extent and an intermediate extent therebetween. A protrusion 34, similar to the one formed upon the upper stand 24, is formed at the intermediate extent of the lower stand 32. This protrusion 28 is illustrated in FIG. 3. The lower stand 32 includes a footbrace 36. The footbrace 36 is perpendicular to the lower stand 32 and is formed proximate to the lower extent. The footbrace 36 enables the entire stand to be inserted into the ground. To facilitate such insertion, the lower extent of the lower stand 32 is pointed or otherwise sharpened. In an assembled state, the lower extent of the upper stand 24 is adapted to be secured to the upper extent of the lower stand 32 by way of the interconnection piece 26.

A butt supporting arm 38 is included within the assembly. This supporting arm 38 is defined by a proximal end, a distal end and an intermediate extent therebetween. In the preferred embodiment the intermediate extent of the butt supporting arm being twisted. Additionally, a square aperture 42 is formed integrally with the proximal end of the arm 38. This square aperture 42 allows the arm to be positioned over and slid down the lower stand 32. The arm 38 is slid downward until the arm 38 comes into engagement with the protrusion 34 of the lower stand 32. In this manner the arm 38 is secured to the lower stand 32. The butt supporting arm 38 also includes an aperture 44 formed at the distal of the arm 38. This aperture 44 functions to secure the butt supporting arm 38 to a butt receiving piece 46 by way of a threaded engagement piece 48.

For the gun supporting assembly depicted in FIG. 1, the butt receiving piece 46 includes a primary support with two upstanding edges. This primary support includes an aperture formed through its thickness. The butt receiving piece 46 for the gun supporting assembly further includes a secondary support secured to and perpendicular with the primary support. The secondary support likewise includes two upstanding edges. A threaded engagement member 48 functions to secure the butt supporting arm 38 to the primary support through the aperture in the primary support and the aperture 44 of the butt supporting arm 38. The construction of this butt receiving piece firmly holds the butt of a rifle or other firearm. In the preferred embodiment, the entire butt receiving piece is dip coated in an elastomeric material to prevent any damage to the gun butt.

The butt receiving piece 46 for the bow supporting assembly is depicted in FIG. 5. This receiving piece includes one single arcuate support. This support includes a slot which facilitates securing the piece to the butt supporting arm. This securement is achieved by way of a threaded engagement member.

The supporting piece 52 for the gun supporting assembly will next be described. This supporting piece 52 is defined by a proximal end and a distal end. Additionally, a square aperture 54 is formed within the proximal end. Furthermore, the distal end is adapted to support the barrel of a gun. In the preferred embodiment, this distal end is arcuate in shape so as to best support the barrel of a rifle. Additionally, the proximal end is adapted to be positioned over the upper extent of the upper stand such that the aperture 54 of the supporting piece 52 comes into contact with the protrusion 28 of the upper stand 24. Furthermore, an angled support element is secured to the upper surface of the supporting piece at the proximal end. This angled support element can be used to support the barrel of a rifle as the rifle is in use. The entire supporting piece is dip coated in an elastomeric material to prevent any damage to gun or rifle.

The supporting piece 52 of the bow supporting assembly is similar to the supporting piece of the gun supporting assembly. However, the distal end is square not arcuate. Additionally, there is no need for the angled support element in the bow supporting assembly.

In use, the assembly is transported to a hunting site in its unassembled state. The lower stand is inserted into the ground via the footstand. Next, the butt supporting arm is slid over the upper extent of the lower stand. The arm is in place when it comes into contact with the protrusion of the lower stand. The appropriate butt receiving piece (bow or gun) is then secured to the arm by way of the threaded engagement member. Next, the upper stand can be secured to the lower stand by the interconnection piece. Lastly, the supporting piece can be secured to the upper extent of the upper stand. The weapon supporting assembly is now ready for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An assembly for supporting a weapon in an upright orientation, the assembly comprising in combination:

an upper square stand having an upper extent and a lower extent, an interconnection piece secured to the lower extent of the upper stand, a protrusion formed proximate to the upper extent;

a lower square stand having an upper extent, a lower extent and an intermediate extent therebetween, a protrusion formed at the intermediate extent of the lower stand, a footbrace perpendicular to the lower stand and formed proximate to the lower extent, the lower extent of the lower stand being pointed to facilitate the insertion of the lower stand into the ground;

a butt supporting arm having a proximal end, a distal end and an intermediate extent therebetween, the intermediate extent of the butt supporting arm being twisted, a square aperture formed integrally with the proximal end, and an aperture formed at the distal of the butt supporting arm, the aperture of the butt supporting arm position over the lower stand and in engagement with the protrusion of the lower stand;

a butt receiving piece having at least two upstanding arms, and aperture formed within the butt receiving piece, a threaded engagement member securing the butt receiving arm to the butt supporting arm by way of the aperture of the butt receiving arm and the aperture in the butt receiving piece, the butt receiving piece being dip coated in an elastomeric material;

a supporting piece having a proximal end and a distal end, a square aperture formed within the proximal end, the distal end adapted to support a weapon, the proximal end adapted to be positioned over the upper extent of the upper stand such that the aperture of the supporting piece comes into contact with the protrusion of the upper stand, the supporting piece being dip coated in an elastomeric material;

the lower extent of the upper stand adapted to be secured to the upper extent of the lower stand by way of the interconnection piece.

2. An assembly for supporting a gun in an upright orientation, the assembly comprising in combination:

an upper stand having an upper extent and a lower extent, an interconnection piece secured to the lower extent of the upper stand, a protrusion formed proximate to the upper extent;

a lower stand having an upper extent, a lower extent and an intermediate extent therebetween, a protrusion formed at the intermediate extent of the lower stand, the lower extent of the lower stand being pointed to facilitate the insertion of the lower stand into the ground;

a butt supporting arm having a proximal end, a distal end and an intermediate extent therebetween, an aperture formed integrally with the proximal end, and an aperture formed at the distal of the butt supporting arm, the aperture of the butt supporting arm position over the lower stand and in engagement with the protrusion of the lower stand;

a butt receiving piece having at least two upstanding arms, and aperture formed within the butt receiving piece, a threaded engagement member securing the butt receiving arm to the butt supporting arm by way of the aperture of the butt receiving arm and the aperture in the butt receiving piece;

a supporting piece having a proximal end and a distal end, a aperture formed within the proximal end, the distal end adapted to support a weapon, the proximal end adapted to be positioned over the upper extent of the upper stand such that the aperture of the supporting piece comes into contact with the protrusion of the upper stand;

the lower extent of the upper stand adapted to be secured to the upper extent of the lower stand by way of the interconnection piece.

3. The assembly for supporting a weapon as described in claim 2 wherein:

the supporting piece and the butt receiving piece are each dip coated in an elastomeric material.

4. The assembly for supporting a weapon as described in claim 2 further comprising:

a footbrace perpendicular to the lower stand and formed proximate to the lower extent.

5. The assembly for supporting a weapon as described in claim 2 wherein:

the intermediate extent of the butt supporting arm is twisted.

* * * * *